US010813430B2

(12) United States Patent
Swatty et al.

(10) Patent No.: US 10,813,430 B2
(45) Date of Patent: Oct. 27, 2020

(54) RAZOR STORAGE SYSTEM AND METHODS OF USE

(71) Applicants: Chistopher Allen Swatty, Scottsdale, AZ (US); William Robert Horner, Chandler, AZ (US)

(72) Inventors: Chistopher Allen Swatty, Scottsdale, AZ (US); William Robert Horner, Chandler, AZ (US)

(73) Assignee: SHAVE HARBOR LLC, Scottsdale, AZ (US)

( * ) Notice: Subject to any disclaimer, the term of this patent is extended or adjusted under 35 U.S.C. 154(b) by 0 days.

(21) Appl. No.: 15/836,761

(22) Filed: Dec. 8, 2017

(65) Prior Publication Data

US 2018/0160790 A1 Jun. 14, 2018

Related U.S. Application Data

(60) Provisional application No. 62/497,902, filed on Dec. 8, 2016.

(51) Int. Cl.
*A45D 27/48* (2006.01)
*A45D 27/22* (2006.01)

(52) U.S. Cl.
CPC ..... *A45D 27/48* (2013.01); *A45D 27/22* (2013.01); *A45D 27/225* (2013.01)

(58) Field of Classification Search
CPC ..... A45D 27/22; A45D 27/225; A45D 27/48
See application file for complete search history.

(56) References Cited

U.S. PATENT DOCUMENTS

| | | | | |
|---|---|---|---|---|
| 4,412,134 A * | 10/1983 | Herold | A61C 19/003 250/455.11 |
| 4,922,626 A * | 5/1990 | Fiddler | F26B 9/003 34/80 |
| 2007/0023940 A1* | 2/2007 | Siess, III | G05D 22/02 261/131 |
| 2011/0099831 A1* | 5/2011 | Parisi | A45D 27/48 34/92 |
| 2015/0059197 A1* | 3/2015 | Sassano | A45D 27/48 34/80 |

* cited by examiner

*Primary Examiner* — Marc E Norman

(57) ABSTRACT

Various embodiments of the present invention provide a razor storage system, which can be used to extend a usable lifetime of a shaving razor. The razor storage system can comprise a razor platform, an air moving device, a controller in communication with the air moving device, and a hygroscopic material, all enclosed in a sealable container. The razor storage system can further comprise a power supply coupled the controller and a switch configured to activate the controller.

20 Claims, 9 Drawing Sheets

RAZOR STORAGE SYSTEM AND METHODS OF USE

CROSS-REFERENCE TO RELATED APPLICATIONS

This patent application claims the benefit of and priority to U.S. Provisional Patent Application Ser. No. 62/497,902, filed Dec. 8, 2016, which is incorporated by reference.

TECHNICAL FIELD

The present invention relates, generally, to systems and methods for storing a razor and, more particularly, to systems and methods for extending the useable lifetime of the razor.

BACKGROUND

The razor industry is known for a marketing strategy in which the seller takes a loss on the device, the razor handle, and makes money on refills, the blades. The industry provides no lifetime on razor blades or any indication that a more expensive blade will last longer than a cheap blade manufactured by the same company.

Many factors can affect razor blade lifetime, such as, frequency of use, surface area shaven, lubricant used on the area, hair thickness, the metal alloy of the razor blade, any coating on the blade, and the number of blades in the razor head. A dull razor blade can irritate skin and may cause rashes, as well as increase the likelihood of cuts and nicks in the skin.

However, oxidation of the blade caused by moisture may have a greater effect on razor blade lifetime than from contact of the blade with the hair on a skin surface. The oxidation of the blade causes the cutting edge to become dulled and jagged, which results in the blade pulling and tearing hairs instead of cleanly slicing through them. Once this happens, it is the end of the lifetime of the razor blade.

Some solutions to limit oxidation of a razor blade have focused on coating the blade to prevent oxidation. However, such coating solutions increase the cost of the razor blade, are limited by coating technology, can alter edge profile of the blade due to coating, and the coating may wear unevenly from use of the razor blade.

Other solutions to limit oxidation of a razor blade have focused on adding a desiccant to a razor container. However, this solution fails if excess water is not removed from the razor. In addition, the razor container is typically stored in a dry area and away from a shower.

Systems and methods are thus needed which overcome these limitations. Various desirable features and characteristics will also become apparent from the subsequent detailed description and the appended claims, taken in conjunction with the accompanying drawings and this background section.

BRIEF SUMMARY

Various embodiments of the present invention provide a razor storage system, which can be used to extend a usable lifetime of a shaving razor. The razor storage system can include a razor platform, a fan, a hygroscopic material, and a controller in communication with the fan, all enclosed in a sealable container. The controller can be coupled to a power supply and a switch, which can activate the controller. The controller can be configured to activate the fan and shut off the fan upon expiration of a predetermined time period and/or upon reaching a predetermined humidity threshold. The predetermined time period is long enough to have the fan circulate the air within the container to assist the hygroscopic material in removing humidity as efficiently as possible.

When it is time to shave, the user opens the lid of the system, removes the razor and utilizes it. After shaving is completed, the user places the razor in a holder. Upon closing the lid, power is provided to the fan to recirculate the air and dry the blades of the razor. Moisture in the recirculated air is removed by a desiccant positioned in the flow of the recirculated air.

Drying the blades of the razor quickly and keeping the blades moisture-free extends the useful lifetime of the blades by limiting or avoiding oxidation and rust to form on the blades.

Various other embodiments, aspects, and features are described in greater detail below.

BRIEF DESCRIPTION OF THE DRAWING FIGURES

Exemplary embodiments will hereinafter be described in conjunction with the following drawing figures, wherein like numerals denote like elements.

Figure 1:
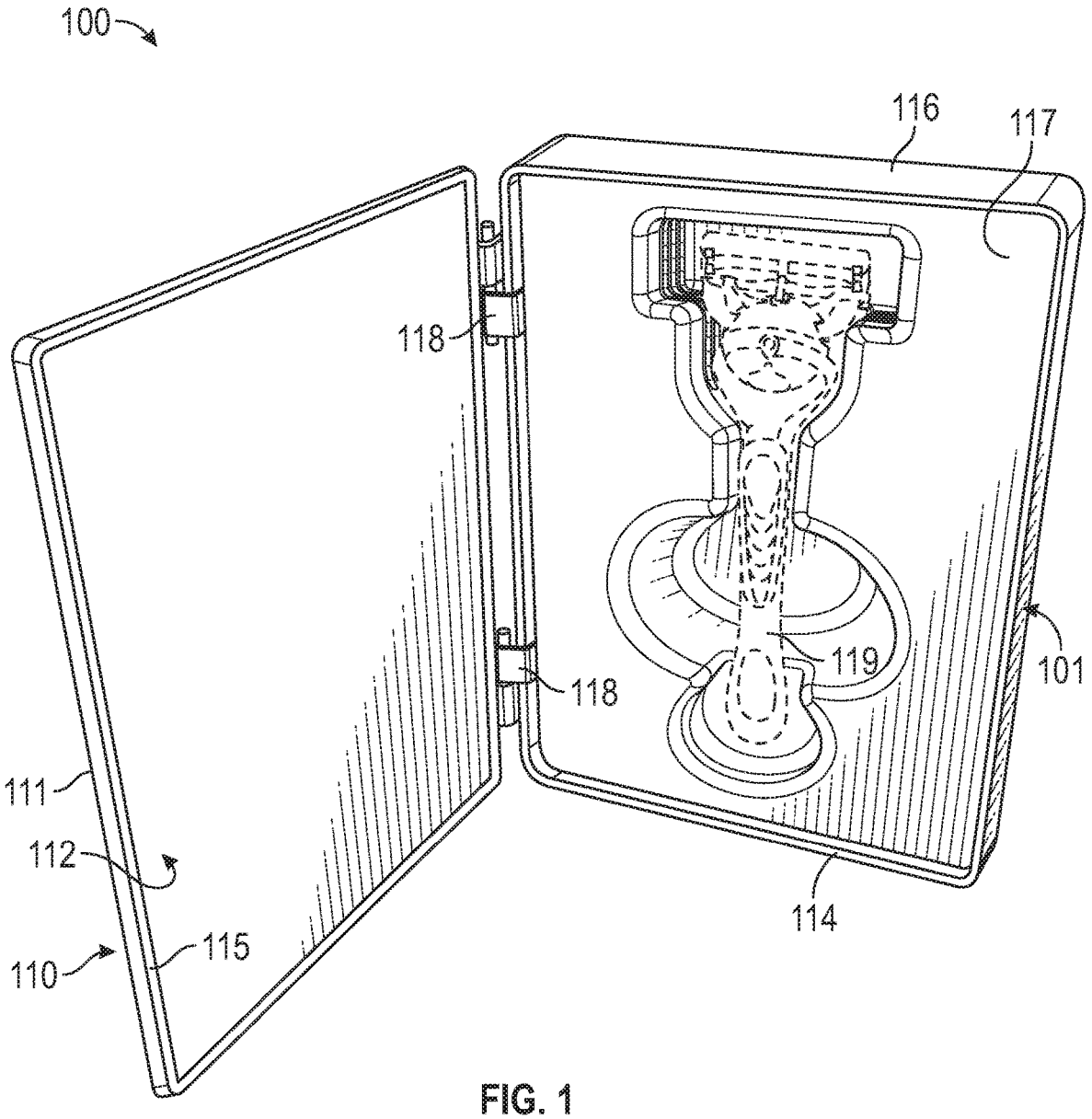
FIG. 1 is a front perspective view illustrating a razor storage system with an opened lid, in accordance with various embodiments.

The drawings described herein are for illustrative purposes only of selected embodiments and not all possible implementations, and are not intended to limit the scope of any of the exemplary embodiments disclosed herein or any equivalents thereof.

DETAILED DESCRIPTION

The following detailed description of the invention is merely exemplary in nature and is not intended to limit the invention or the application and uses of the invention. Furthermore, there is no intention to be bound by any theory presented in the preceding background or the following detailed description.

Some embodiments provide a razor storage system comprising: a sealable container; a razor platform coupled to an inside portion of the sealable container; an air moving device below the razor platform and in fluid communication with a passage through the razor platform; a controller configured to control the air moving device; and a desiccant configured to receive at least a portion of a fluid traveling through the passage.

The air moving device can be a fan, which can be powered either by a direct current, low voltage circuit, or a USB source. The fan is configured to circulate air inside the container through slots in the razor platform and onto the razor blades. Upon closure of the lid, a circuit on the controller is closed, which powers the fan to circulate the air through and around desiccant packets to absorb moisture within the container. The purpose of circulating the air is to maximize the effectiveness of the desiccant thereby drying the razor in the fastest and most efficient manner. Once the power through the circuit is depleted the fan turns off until the sealable container is opened and closed again.

The fan can move air in an axial direction through the slots in the platform and onto the razor blades, which increase the rate of evaporation of water on the blades. The fan can dry the razor blades quickly, which lowers the chance of microbe growth on the blades In some designs of the system, the sealable container can be large enough to hold a razor, a battery, a fan, desiccant, and a DC powered circuit, which controls the fan circulating the air through the razor head chamber. In another designs of the system, a travel version of the sealable container will be sized smaller for ease of packing and can be just large enough to hold a razor, desiccant, a micro fan with controller and a USB port to connect the system to a power supply, such as a wall plug, a computer, or a charging port.

The razor storage system can include a razor platform, a fan, a hygroscopic material, and a controller in communication with the fan, all enclosed in a sealable container. The controller can be coupled to a power supply and a switch, which can activate the controller. The controller can be configured to activate the fan and shut off the fan upon expiration of a predetermined time period and/or upon reaching a predetermined humidity threshold.

As used herein, a "hygroscopic material" is any substance, which able to absorb or adsorb water from its surroundings. Examples of a hygroscopic material, include, but are not limited to, desiccants, molecular sieves, and clays. Some natural products can be a hygroscopic material, such as, but not limited to, rice, seeds, activated charcoal, and honey. Some synthetic products can be a hygroscopic material, such as, but not limited to, nylon, acrylonitrile butadiene styrene, polycarbonate, cellulose, and poly(methyl methacrylate). Many salts are a hygroscopic material, such as, but not limited to, zinc chloride, sodium chloride, calcium chloride, and calcium sulfate. Silica gel is an excellent hygroscopic material.

Silica gel has a very high porosity, which allows it to adsorb water readily, making it useful as a desiccant. It can reduce the relative humidity in a closed space to around 40%. Once saturated with water, the gel can be regenerated by heating it to 150° C. An advantage of silica gel is the physical adsorption of water vapor into its internal pores with no chemical reaction, no by products or side effects. Even when saturated with water vapor, silica gel still has the appearance of a dry product and its shape is unchanged. In some embodiments, the hygroscopic material is silica gel.

Some embodiments provide a razor storage system comprising: a box; a lid; a hinge coupled to the box and the lid; a liner positioned in the box and configured to hold a razor; a controller; a power supply coupled to controller; a fan powered by the controller; a switch in communication with the controller and configured to be activated by the lid; and a desiccant. The system can further comprise at least one magnet configured to fasten the lid to the box.

FIG. 1 is a front perspective view illustrating a razor storage system 100 with an opened lid 110. The razor storage system 100 comprises a sealable container 101, which is sized to encase a razor holder, a control system, and a hygroscopic material. For example, the sealable container 101 can be varying dimensions, such as, one set of dimensions for a home-use razor storage system 100, and a smaller set of dimensions for pocket-sized system 101 for travel use.

The sealable container 101 be constructed of varying materials, including but not limited to, wood, metal, plastics, foams, carbon fiber, and combinations thereof. The exterior of the sealable container 101 can be cloth covered, can have a finished surface of a base material, or be covered with any of an innumerable number of exterior designs.

The sealable container 101 can be an open box structure 116 coupled to a lid 110 by at least one hinge 118. The open box 116 has an edge 114 around a top portion of the open box 116. The lid 110 has a front surface 111, an inside surface 112, and an outer edge 115 on the inside surface 112. The front surface 111 can be a mirror. The lid 110 can be made of a transparent material, such as a plastic or glass, which allows a user to view the razor 119 in the container 101. The inside surface 112 can be a mirror. However, the inside surface 112 can include a waterproof pocket which can be configured to hold one or more photos, drawings, spiritual cards, notes, or facial scrubs.

In some configuration, the outer edge 115 of the lid 110 fits over the edge 114 of the open box 116. In this configuration, the lid 110 is bigger than an opening and the edge 115 of the box 116. The lid 110 can have a flare around the outer edge 115, which is orthogonal to the front surface 111 and configured to fit over the open box 116 and to provide a seal to outside moisture from entering the container 101. In other configurations, the lid 110 is the same size of the opening and the edge of the box 116

The outer edge 115 of the lid 110 can comprise a seal (not shown), which is configured to prevent moisture from entering into the container 101 when the lid 110 is in a closed position. The edge 114 of the open box 116 can comprise a seal (not shown), which is configured to prevent moisture from entering into the container 101 when the lid 110 is in a closed position. In some configurations, the edge 114 of the open box 116 and the outer edge 115 of the lid 110 each have a seal. For example, a lid 110 seal and a box edge 114 seal can be configured to interlock with each other to provide a water tight seal. Some configurations can include a lid 110 seal and a box edge 114 seal configured so that the sealable container 101 is waterproof while the lid 115 seal is engaged with the box edge 114 seal.

Seal materials can include natural rubber, synthetic rubber, elastomers, plastic, foam, neoprene, silicone, and other flexible materials, which are water resistant. A seal can be a gasket, which is coupled to the edge 114 of a box 116 or to the outer edge 115 of a lid 110. Technology for sealing a lid 110 to a box 116 to prevent moisture from entering the container 101 is well known to those skilled in the art.

In some configurations, the outer edge 115 of the lid 110 and edge 114 of the open box 116 are configured to prevent moisture from entering the container 101 when the lid 110 is closed without the use of a seal. In an example, the outer edge 114 of the lid 110 and edge 114 of the open box 116 can be finished to a prescribed standard, which is configured to provide a seal went the finished edges 114, 115 are engaged.

The outer edge 115 of the lid 110 can include a groove configured to receive the edge 114 of the open box 116.

The sealable container 101 can comprise a locking system (not shown) configured to keep the lid 110 engaged with the edge 114 of the open box 116 when the container 101 is closed. The locking system can include a latch, a hasp, one or more magnets, a push button, a slide bolt, a clamp, twist and lock mechanism, an electronic locking mechanism, or any other appropriate fastener or locking system, now known or developed in the future.

The razor storage system 100 includes a platform 117, which is coupled to the interior of the sealable container 101. The platform 117 is configured to hold a razor 119.

Figure 2:
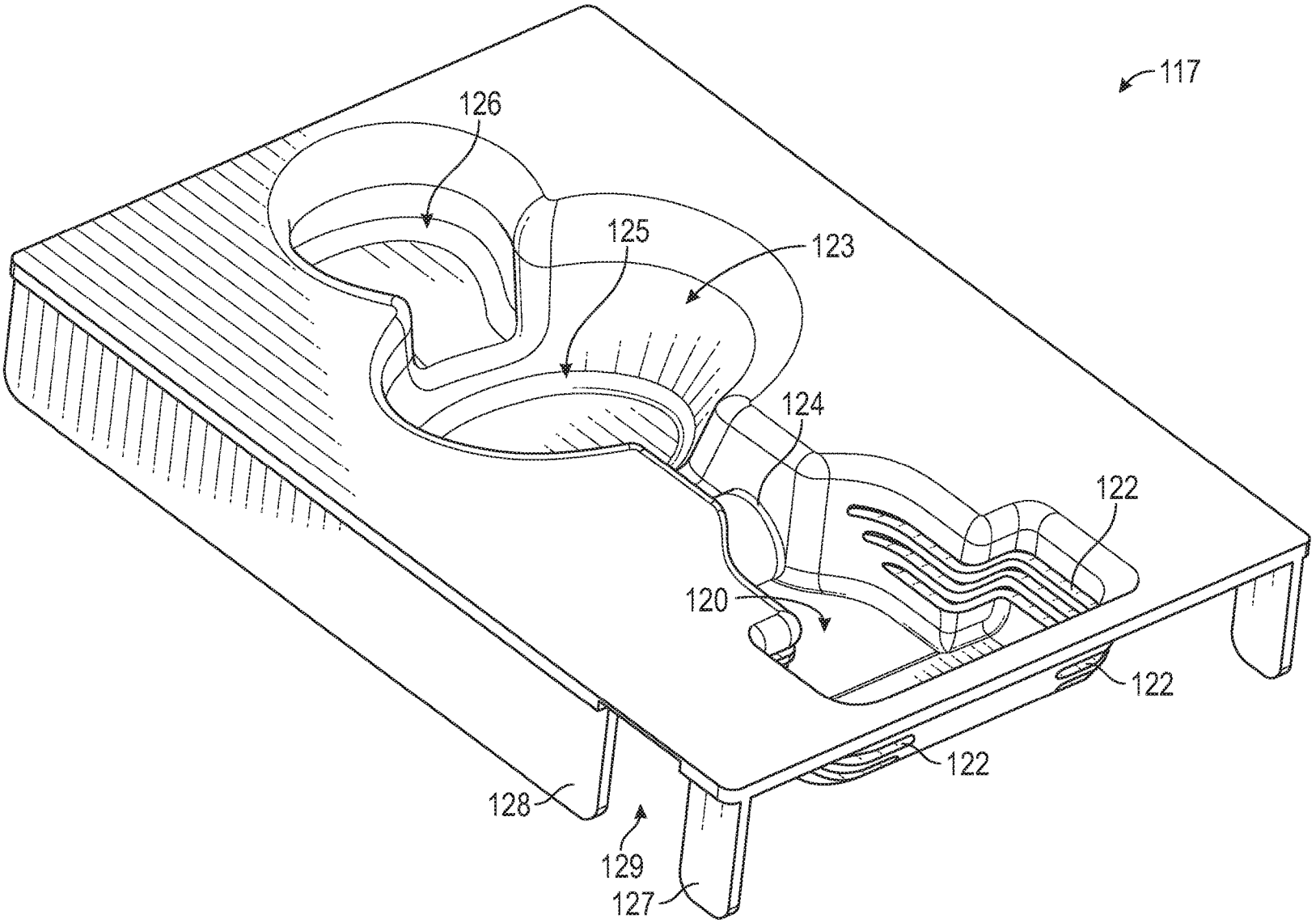
FIG. 2 is a top front perspective view of a razor platform, in accordance with various embodiments.
Figure 3:
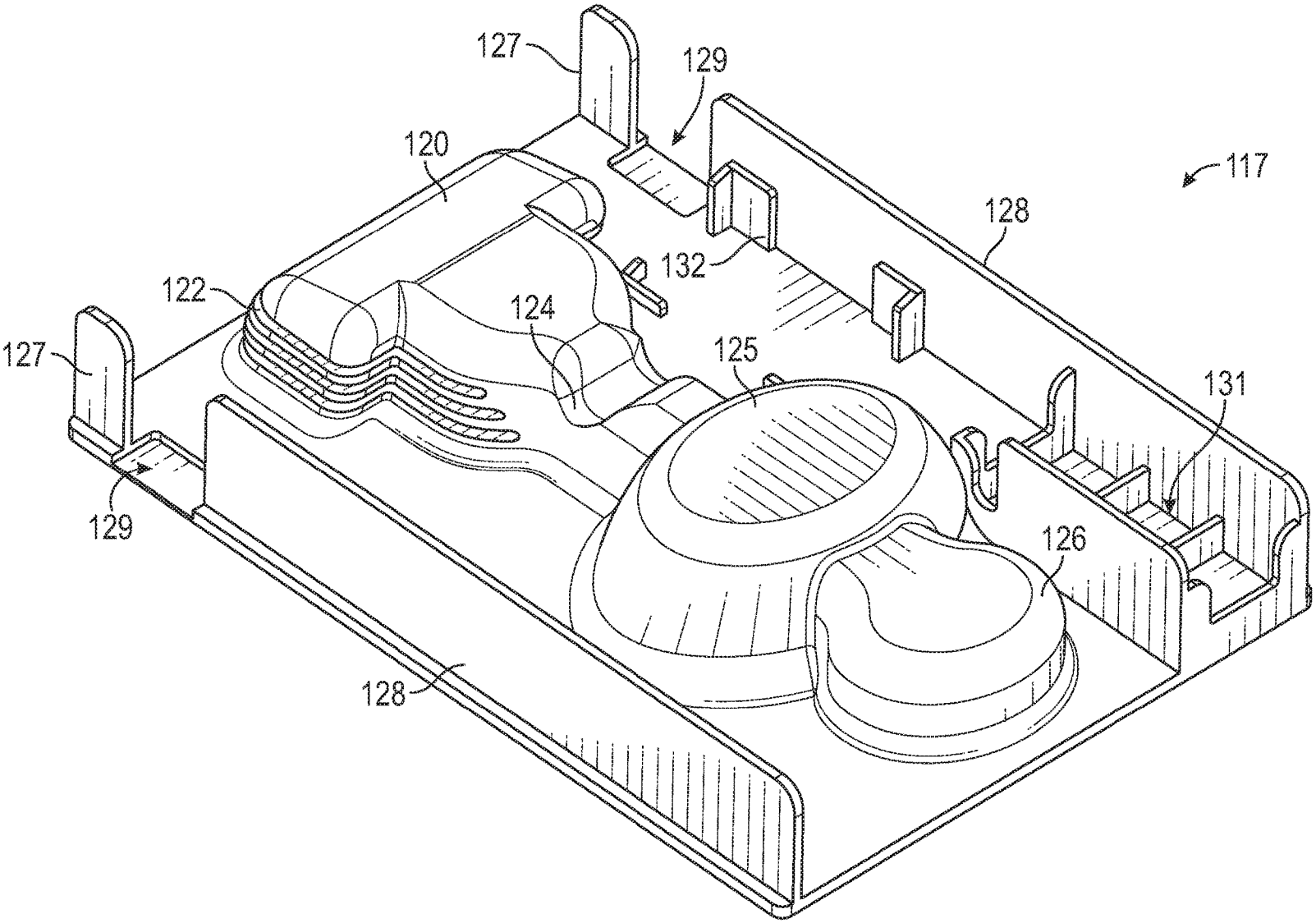
FIG. 3 is a bottom back perspective view of the razor platform of FIG. 2, in accordance with various embodiments.

FIG. 2 is a top perspective view of an exemplary razor platform 117, and FIG. 3 is a bottom top perspective view of the exemplary razor insert 117. The razor platform 117 can comprise a pair of sides 128, which are sized to hold the platform 117 at predetermined height above the bottom surface of the open box 116. The platform 117 can comprise a pair of spacers 127, which are sized to the same height dimension as the pair sides 128. A vent 129 can be located between the side 128 and the spacer 127.

The razor platform 117 comprises a razor insert 123, which comprises a razor head chamber 120, a razor holder 124, and a razor tail pocket 126. The razor insert 123 can be sized to receive a variety of different razor blades and associated handles from a variety of different manufacturers. The razor head chamber 120, the razor holder 124, and the razor tail pocket 126 all can be configured to be in contact with the razor. The razor holder 124 can be configured for a razor handle to slip lock in and out of the razor holder 124.

The razor head chamber 120 has a plurality of slots 122 (or holes of any shape) cut through the side walls of the chamber 120. The slots 122 can be configured for air flow to pass over the blades of the razor, which has been placed in the razor insert 123. The slots 122 can be a passage for a fluid (such as air) to enter the chamber 120 and pass through the chamber 120.

The razor insert 123 can comprise a finger cavity 125, which can be configured for grasping a razor handle and removing it from the razor platform 117. Since it can be easier to remove the razor if the user's fingers can wrap around the razor, the finger cavity 125 is not in contact with the razor.

Viewing the bottom side as illustrated in FIG. 3, the razor platform 117 can comprise a power supply holder 131 configured to receive a power supply component. The razor platform 117 can comprise a controller holder 132 configured to receive a controller circuit board.

Figure 4:
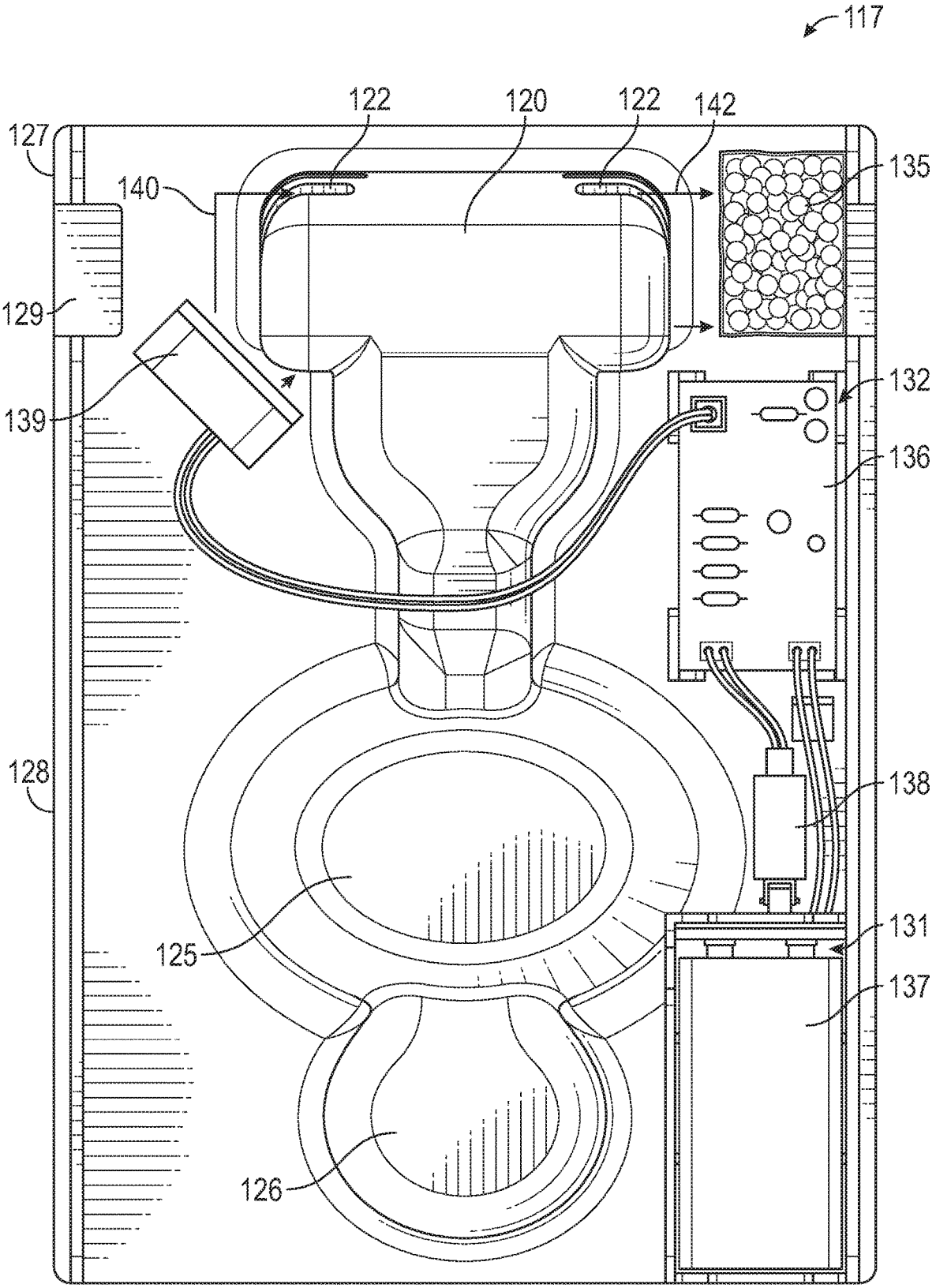
FIG. 4 is a bottom planar view of a razor platform illustrating an electronics system, in accordance to various embodiments.

Moving to FIG. 4, a bottom planar view of the razor platform 117 illustrates an electronics system. In some embodiments, the electronics system comprises a power supply 137, a controller 136, an air moving device 139, and a switch 138.

The power supply 137 is held by power supply holder 131 and is coupled to controller 136. The controller 136 is held by controller holder 132 and is in communication with the switch 136 and the air moving device 139.

The air moving device 139 is positioned to move air 140 through the slots 122 of the razor head chamber 120. The air moving device 139 can be an axial fan, which moves air 140 parallel to the center axis of the fan. The air moving device 139 can be in fluid communication with the slots 122. The air moving device 139 can move air in an axial direction through the slots 122 in the chamber 120 and onto the razor blades located in the chamber 120, which increases the rate of evaporation of water on the blades. The air moving device 139 can dry the razor blades quicker, which lowers the chance of oxidation forming on the blades. The air moving device 139 create a fluid flow of air through the slots 122 configured to remove a droplet of water from a surface of at least one blade in the chamber 120.

The hygroscopic material 135 is positioned on the opposite side of the razor head chamber 120. The hydroscopic material 135 is positioned to receive moist air 142 from the slot 122. The air flow 142 can be forced across the hygroscopic material 135, which can lower the humidity inside the sealed container.

Figure 5A:
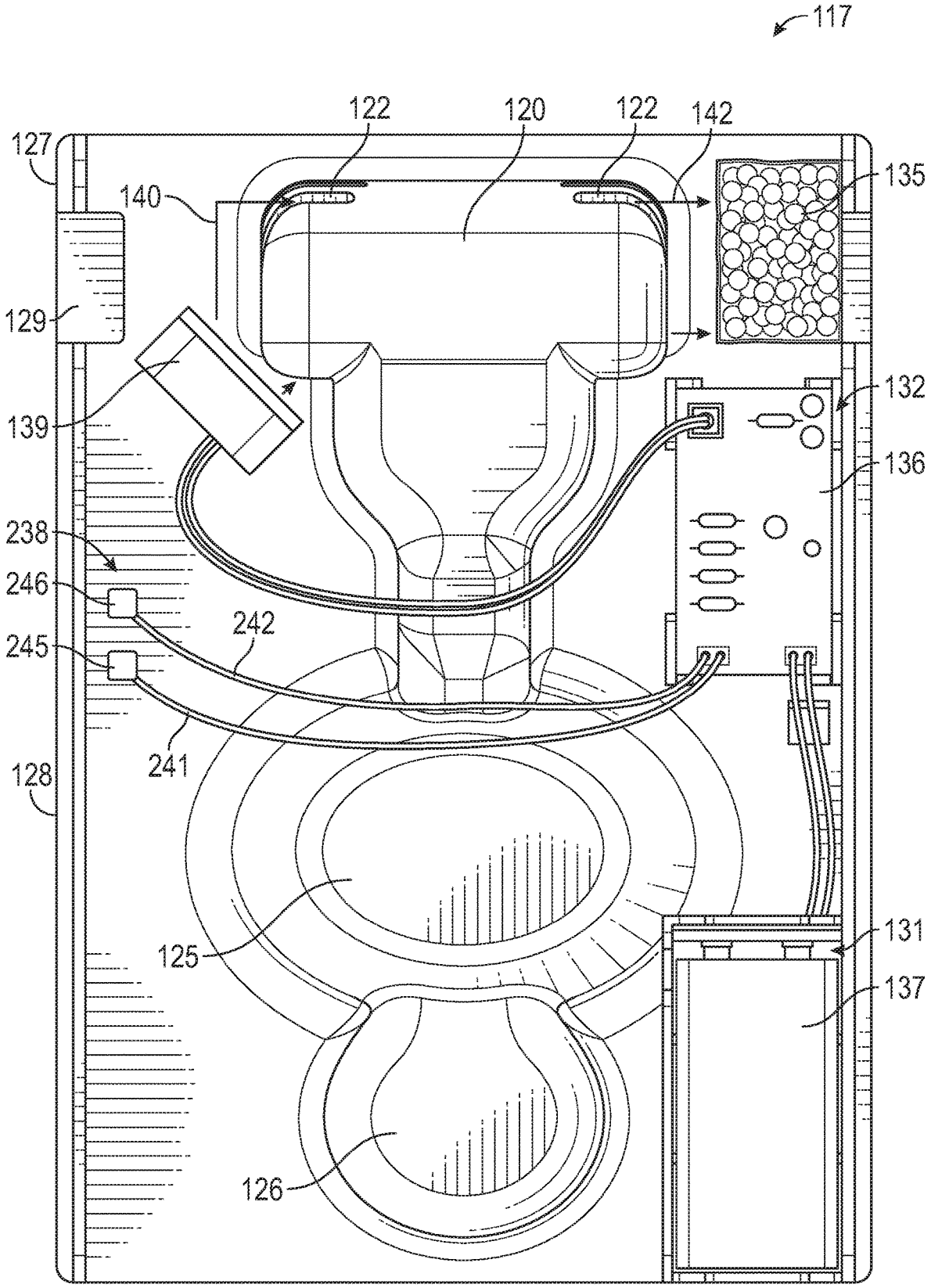
FIG. 5A is a bottom planar view of a razor platform illustrating an alternative electronics system, in accordance to various embodiments.
Figure 5B:
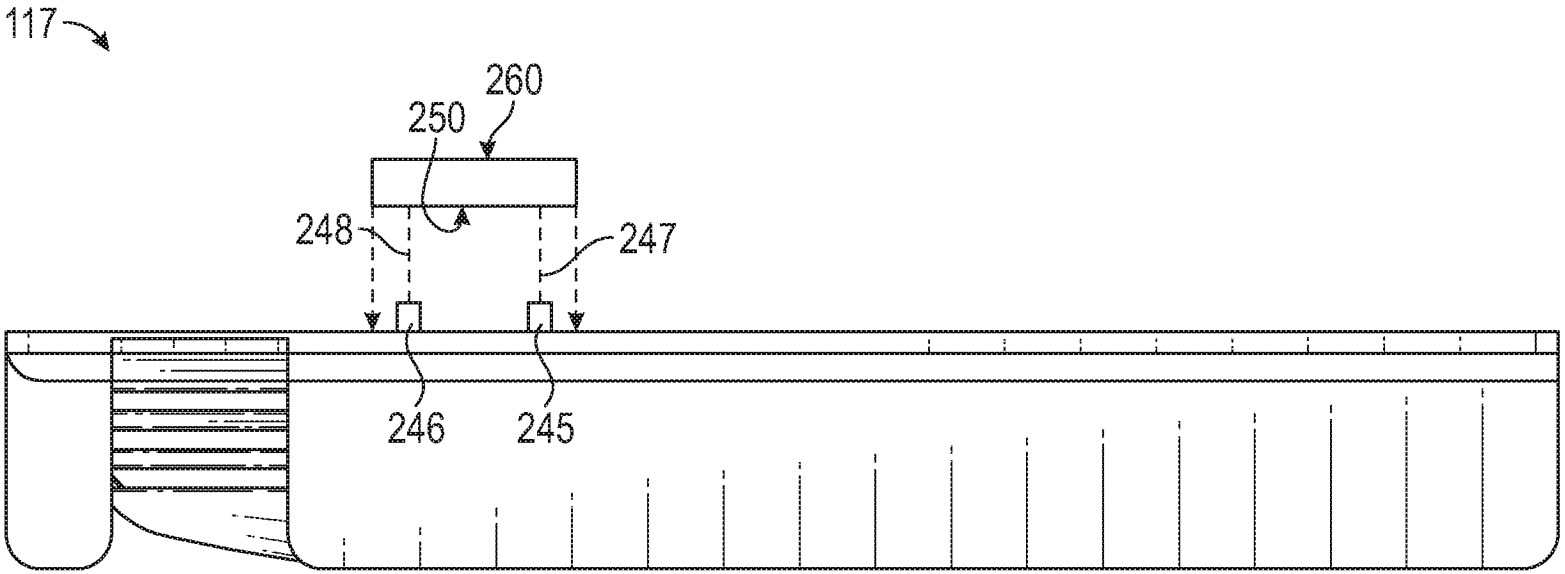
FIG. 5B is a side view of the razor platform illustrating the switch of the alternative electronics system of FIG. 5A, in accordance to various embodiments.

Turning to FIGS. 5A and 5B, a bottom planar view of the razor platform 117 illustrates an alternative electronics system. Any component with the same reference number as in FIG. 4, was described in the text above and such description will not be repeated here.

The power supply 137, the controller 136, and the air moving device 139, of the alternative electronics system, are the same as described in FIG. 4. However, switch 238 is different. The switch 238 couples to the controller 136. As illustrated in FIG. 5A, the switch 238 has a metal contact 245 and a metal contact 246, located a distance apart to create an open circuit. These metal contacts 245, 246 go through the platform 117 and are accessible in the top side of the platform 117. As illustrated in FIG. 5B, a bottom side 250 of a metal magnet 260 magnetically attaches 247 to metal contact 245 and magnetically attaches 248 to metal contact 246, which closes the circuit and activates the controller 136.

The metal magnetic 260 easily conducts electricity. For example, the metal magnet 260 can comprise iron, cobalt, or nickel, either as a pure metal or as an alloy. The metal magnet 260 can attached to lid 110, the magnetic attraction of the metal magnet 260 to the metal contacts 245, 246, is great enough to hold the lid 110 closed onto the box 116 of the sealable container 101. The metal magnet 260 activates the controller 136 when the lid 110 is opened then closed.

Figure 6:
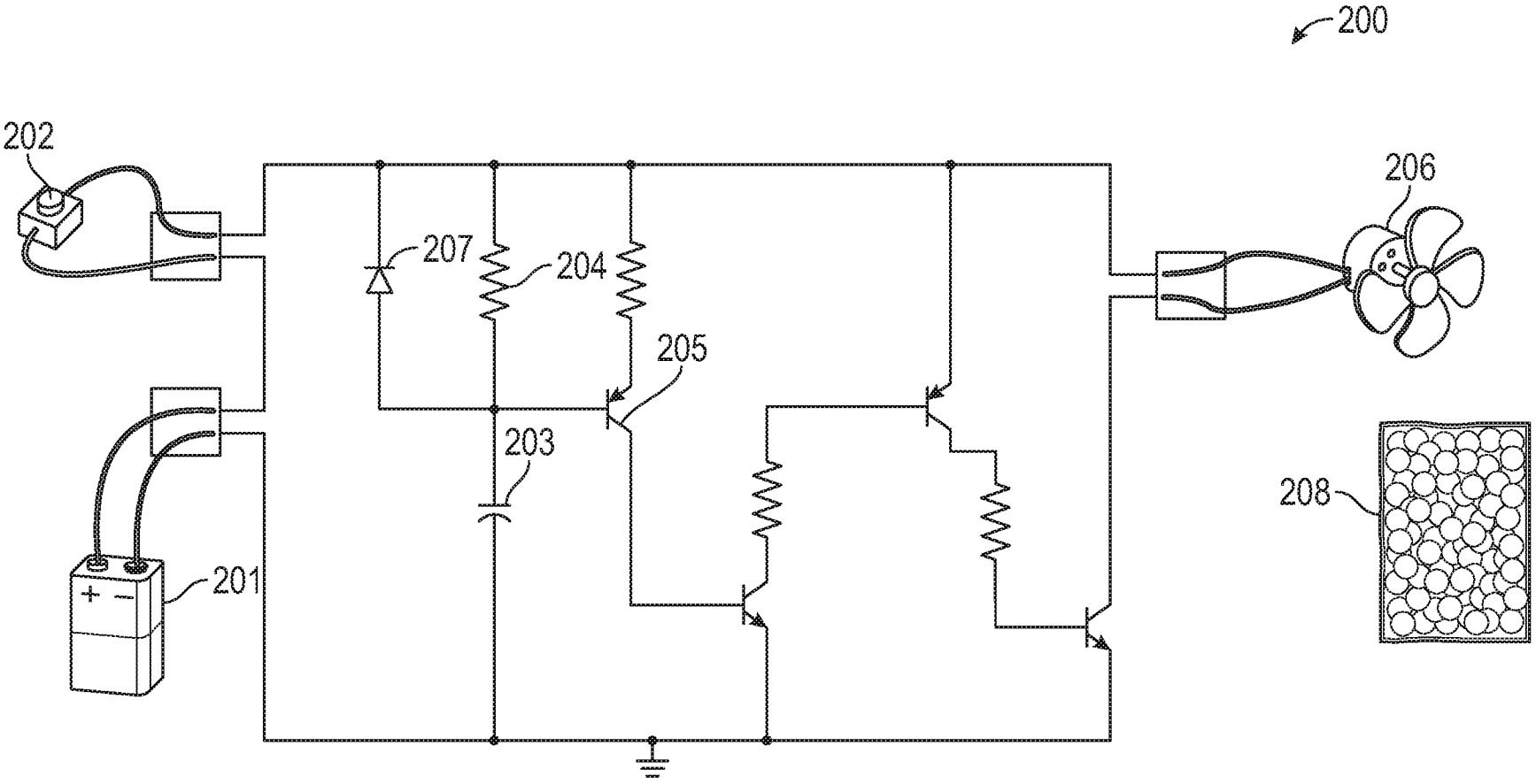
FIG. 6 is a schematic illustrating an exemplary controller circuit, in accordance to various embodiments.

As illustrated in the schematic of FIG. 6, an exemplary controller circuit 200 can comprise a power supply 201, a switch 202, timer control capacitor 203, a timer control 204, a resistor main switch transistor 205, a fan 206, and a capacitor discharge assist diode 207.

In operation, when switch 202 is closed and the circuit is completed, and the power supply 201 sends power to the circuit, charging the timer control capacitor 203, via timer control resistor 204. If the timer control capacitor 203 voltage is less than 4.5 volts, the main switch transistor 205 is turned on, which powers the fan 206, via the balance of the circuit. As discussed herein, the fan 206 circulates air in the sealed container over the drying agent 208.

When the voltage exceeds 4.5 volts across the timer control capacitor 203, the main switch transistor 205 turns off the balance of the circuit 200, thereby turning off the fan 206. In some configurations, the timer control capacitor 203 will take about 20 seconds to charge to the 4.5 volts level, allowing the fan 206 to run for about 20 seconds. The time for the timer control capacitor 203 to reach a specific charge level is dependent on the timer control resistor 204 and the back EMF from the fan 206, which varies as the fan 206 spins. The fan 206 time can be varied, longer or shorter, by substituting the capacitor, the resistor, the fan, and/or the transistor of the control circuit 200. In some configurations, the fan 206 time can be varied, longer or shorter, by user input via a knob or a set of buttons, which is in communication with the control circuit 200.

When switch 202 is opened, the timer control capacitor 203 begins to discharge back to 0 volts via the capacitor discharge assist diode 207. Once the timer control capacitor 203 is discharged, the circuit is ready to be energized again to turn the fan 206 on for another 20 seconds.

In some embodiments, the circuit 200 can include a humidity sensor. In such embodiments, the fan 206 run time is based on a threshold humidity instead of a predetermined amount of time. In an example with a humidity threshold of 50%, the circuit 200 powers the fan 206 until the humidity sensor signals the humidity is 50%, which thereby shuts off power to the fan 206. In some embodiments, the circuit can include a humidity sensor and a timer. In such embodiments, the fun 206 run time is based on a threshold humidity, however, if the threshold humidity is not reach with in a predetermined time period, the circuit 200 shuts off power to the fan 206 upon expiration of the predetermined time period.

Figure 7:
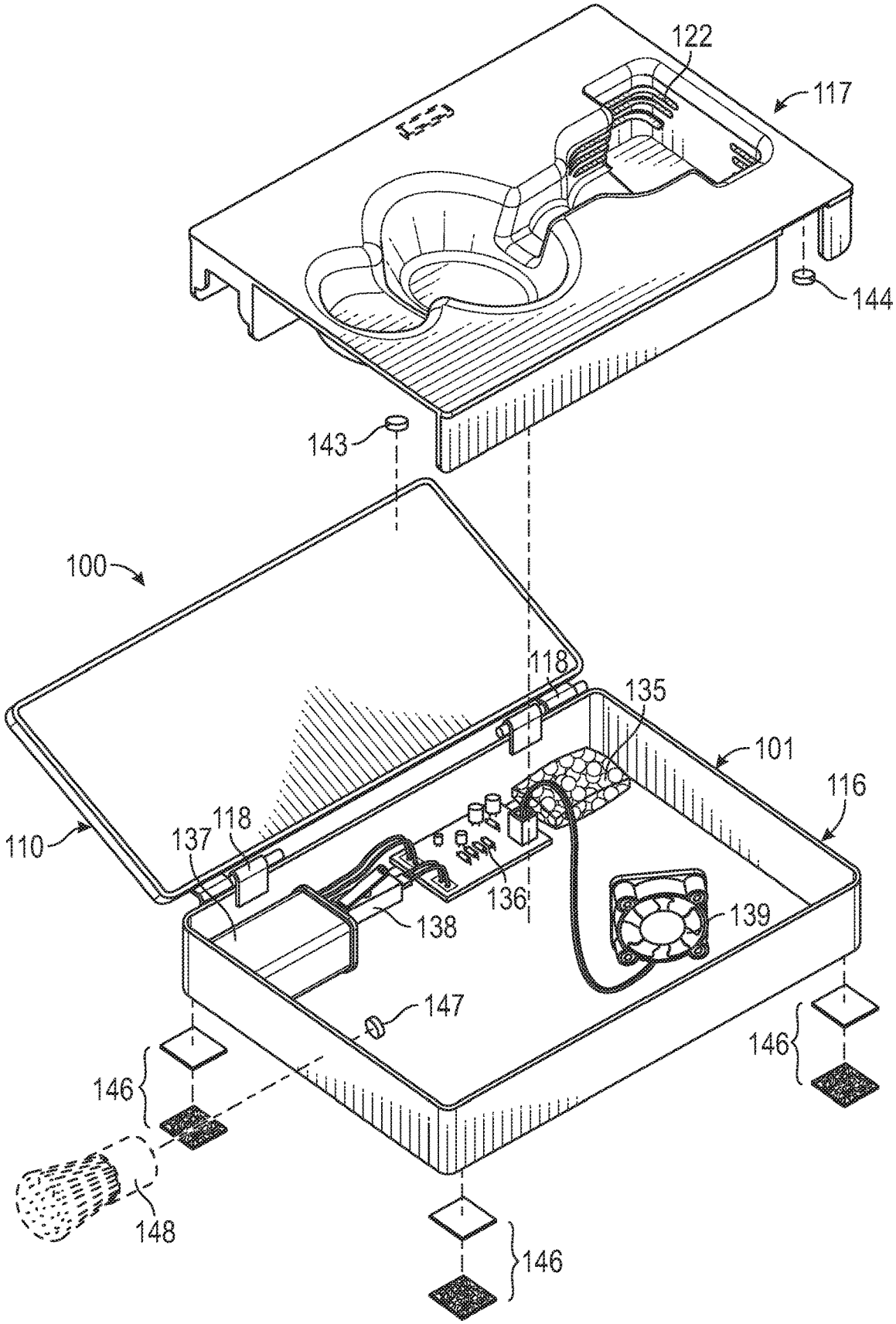
FIG. 7 is a top perspective exploded view illustrating an exemplary arrangement of components in a razor storage system, in accordance to various embodiments.

FIG. 7 is a top perspective exploded view illustrating an exemplary arrangement of components in a razor storage system 100. This arrangement is only one example of many different arrangements of components contemplated by the disclosure herein. The arrangement of the components in this figure are meant to be limiting. The razor storage system 100 comprises a sealable container 101, which is an open box 116 coupled to a lid 110 by a pair of hinges 118. The lid 110 includes a magnetic portion 143 on inside surface of the lid 110.

The electronics system is arranged in the interior of the open box 116. The power supply 137 is located in the lower left corner of the open box 116. A power supply access door in the back of the open box 116 can be included for access to the power supply 137. For example, the power supply access door would be opened to replace a battery, if a battery was used as the power supply 137. The power supply 137 is coupled to controller 136. The controller 136 is in communication with the switch 138 and the fan 139. The fan 139 is positioned in the upper right corner of the open box 116. The fan 139 is positioned to move air through the slots 122 on the right side of the platform 117.

The hygroscopic material 135 is positioned in the upper left corner of the open box 116. The hydroscopic material 135 is positioned to receive an air flow from the slot 122 on the left side of the platform 117. A desiccant access door in the back of the open box 116 can be included for access to the hygroscopic material 135. For example, the desiccant access door would be opened to replace the hygroscopic material 135 or to remove the hygroscopic material 135 for regeneration.

The platform 117 is coupled to the interior of the open box 116, such that the electronics system and the hygroscopic material 135 are located below the platform 117. A magnetic portion 144 is located on the underside of the platform 117. The magnetic portion 144 is positioned to engage with the magnetic portion 143 on the lid 110 and is configured to lock the lid 110 to the open box 116 of the sealable container 101.

A plurality of fasteners 146 can be attached to the backside of the sealable container 101. The plurality of fasteners 146 are configured to mount the razor storage system 100 to a surface. In one example, the fasteners 146 are hook and loop fasteners (Velcro) having the loop portion adhered to the back of the container 101 and the hook portion adhered to a shower wall. Such a fastener system allows for the removal and reattachment of the razor storage system 100.

An accessory 148 can be attached to the razor storage system 100. The accessory 148 can be held on a side of the open box 116 by magnet 147. An example of the accessary 148 is a shave lather brush. The lid 110 can include a mirror surface on the outer surface of the lid 110.

Figure 8:
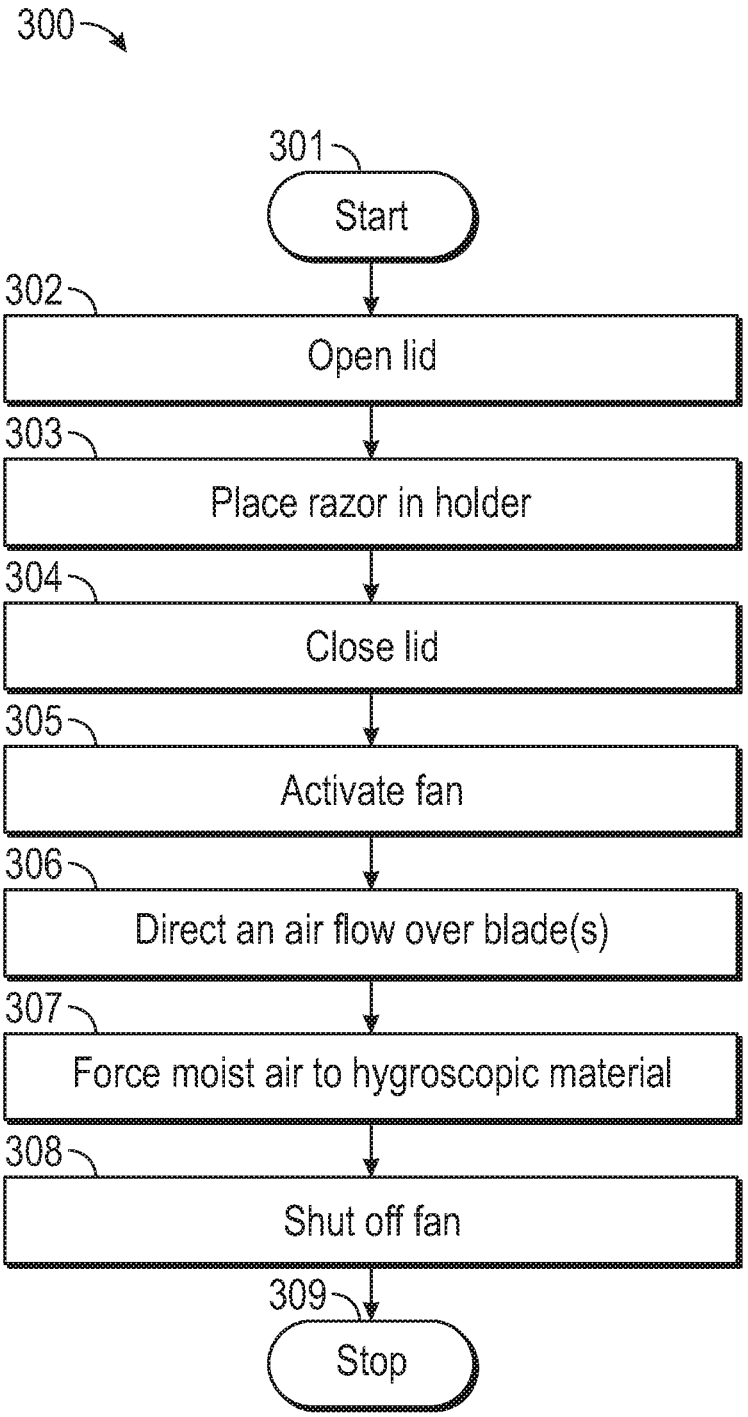
FIG. 8 is a flowchart illustrating exemplary steps of a method to extend a lifetime of a razor, in accordance to various embodiments.

The flow chart of FIG. 8 illustrates exemplary steps of a storage method for extending a usable lifetime of a razor. In various embodiments, the method 300 starts (Step 301) with a user having a razor and access to a razor storage system, as described herein. The user opens the lid (Step 302) of the razor storage system. The user then places the razor in a holder inside the razor storage system (Step 303). The user then closes the lid (Step 304), which activates the fan (Step 305). The activating the fan can include engaging a switch or completing a circuit. The fan directs an air flow across at least a portion of the blade or set of blades of the razor (Step 306). The directing air across at least a portion of the blade or set of blades can be followed by the step of removing at least one water droplet from the blade or set of blades. The directing air across at least a portion of the blade or set of blades can be followed by the step of increasing the rate of evaporation from the surface of the blade or set of blades. After the air flow passes the blade or set of blades, the resulting moist air is forced to across a hygroscopic material (Step 307). The forcing moist air to the hygroscopic material can be followed by the step of removing a portion of the moisture from the moist air. The forcing moist air to the hygroscopic material can be followed by the step of lowering the relative humidity inside the sealed container. The controller shut off the fan (Step 308). The shutting off the fan can include stopping power directed to the fan.

The controller can shut off the fan after a predetermined time period. The predetermined time period can be controlled by a timer device in a controller circuit. The controller can shut off the fan after a humidity sensor signals that the humidity has been lowered to a predetermined humidity threshold.

In some embodiments, the predetermined time period is in a range between 10 seconds and 120 seconds. The predetermined time period can be in a range between 10 seconds and 60 seconds. The predetermined time period can be in a range between 15 seconds and 45 seconds. The predetermined time period can be in a range between 20 seconds and 30 seconds.

In some embodiments, the predetermined time period can be 20 seconds plus or minus 2 seconds. The predetermined time period can be 20 seconds plus or minus 1 second. The predetermined time period can be 20 seconds.

In other embodiments, the predetermined time period can be 30 seconds plus or minus 2 seconds. The predetermined time period can be 30 seconds plus or minus 1 second. The predetermined time period can be 30 seconds.

In some embodiments, the predetermined time period can be adjusted to a longer or shorter period by the user. For example, the user can select a predetermined time period in a range between 10 seconds and 120 seconds. The selection of the predetermined time period can be selected using a knob, a set of buttons, or other such device, which is in communication with the controller. In one configuration, the predetermined time period can be selected via an app on a smart device (such as, but not limited to, a smart phone, a tablet, or a watch), which is in wireless communication with the controller.

In some embodiments, the humidity threshold is in a range between 30% and 80%. The humidity threshold can be in a range between 40% and 70%. The humidity threshold can be in a range between 50% and 60%. The humidity threshold can be in a range between 50% and 80%.

In some embodiments, the humidity threshold can be 60% plus or minus 5%. The humidity threshold can be 50% plus or minus 5%. The humidity threshold can be 40% plus or minus 5%.

Before shaving the user can open the lid of the razor storage system and retrieve the razor. After retrieving the razor, the user can close the lid, which can activate the fan to direct air flow through the razor head chamber. The air flow then can be forced across the hygroscopic material, which can lower the humidity inside the sealed container.

The method can include a step of installing the razor storage system on a wall. The method can include a step of installing the razor storage system in a shower. The method can include a step of storing a razor in the razor storage system in a wet environment. The method can include a step of engaging a seal between the lid and the open box of the container.

Various embodiments of the present invention provide a razor storage system, which can be used to extend a usable lifetime of a shaving razor. The razor storage system can include a razor platform, a fan, a hygroscopic material, and a controller in communication with the fan, all enclosed in a sealable container. The controller can be coupled to a power supply and a switch, which can activate the controller. The controller can be configured to activate the fan and shut off the fan upon expiration of a predetermined time period and/or upon reaching a predetermined humidity threshold. The predetermined time period is long enough to have the fan circulate the air within the container to assist the hygroscopic material in removing humidity as efficiently as possible.

When it is time to shave, the user opens the lid of the system, removes the razor and utilizes it. After shaving is completed, the user places the razor in a holder. Upon closing the lid, power is provided to the fan to recirculate the air and dry the blades of the razor. Moisture in the recirculated air is removed by a desiccant positioned in the flow of the recirculated air.

Drying the blades of the razor quickly and keeping the blades moisture-free extends the useful lifetime of the blades by limiting or avoiding oxidation and rust to form on the blades.

Some embodiments provide a razor storage system comprising: a sealable container; a razor platform coupled to an inside portion of the sealable container; an air moving device below the razor platform and in fluid communication with a passage through the razor platform; a controller configured to control the air moving device; and a hygroscopic material configured to receive at least a portion of the air traveling through the passage.

The sealable container can comprise a lid.

The system can include a switch coupled to the controller and configured to activate by the closing of the lid.

The system can include a power supply coupled to the controller and configured to provide power to the controller.

The power supply can be a battery.

The power supply can be a USB port configured to receive power from a computer, a wall plug, or a charging port.

The hygroscopic material can be silica gel.

The controller can be configured to activate the air moving device and then to terminate power to the air moving device upon at least one of an expiration of a predetermined time period and upon reaching a predetermined humidity threshold.

Some embodiments provide a method of extending a lifetime of a shaving razor. The method can include the steps of: providing a razor storage system; opening a lid of the razor storage system; placing a razor into a holder inside the razor storage system; closing the lid; activating a fan in the razor storage system; directing an air flow across at least a portion of a blade of the razor; and forcing moist air across a hygroscopic material, thereby lowering humidity in the razor storage system.

The method can include terminating power to the fan after a predetermined time period.

In some configurations, the predetermined time period is in a range from 20 seconds to 120 seconds.

In some configurations, the predetermined time period is about 20 seconds.

In some configurations, the predetermined time period is about 30 seconds.

The method can include terminating power to the fan upon reaching a humidity threshold.

In some configurations, the humidity threshold is in the range between 40% and 70%.

The method can include terminating power to the fan upon reaching a humidity threshold or upon expiration of a predetermined time period.

The method can include removing at least one water droplet from the at least a portion of a blade of the razor.

Some embodiments provide a razor storage system for extending a usable lifetime of razor blades. The razor storage system can comprise a box; a lid; a hinge coupled to the box and the lid; a platform positioned in the box and configured to hold a razor; a controller; a power supply coupled to controller; a fan powered by the controller; a switch in communication with the controller and configured to be activated by the lid; a desiccant; and a magnet configured to fasten the lid to the box in a closed position.

In some configurations, the platform comprises a plurality of vents configured to allow an air stream generated by the fan to pass thru the platform and contact the desiccant.

In some configurations, the controller is configured to activate the fan and then to terminate power to the fan upon at least one of an expiration of a predetermined time period and upon reaching a predetermined humidity threshold.

As used herein, the word "exemplary" means "serving as an example, instance, or illustration." Any implementation described herein as "exemplary" is not necessarily to be construed as preferred or advantageous over other implementations, nor is it intended to be construed as a model that must be literally duplicated.

As used herein, the phrase "at least one of A, B, and C" can be construed to mean a logical (A or B or C), using a non-exclusive logical "or," however, can be contrasted to mean (A, B, and C), in addition, can be construed to mean (A and B) or (A and C) or (B and C). As used herein, the phrase "A, B and/or C" should be construed to mean (A, B, and C) or alternatively (A or B or C), using a non-exclusive logical "or."

It should be understood that steps within a method may be executed in different order without altering the principles of the present disclosure. For example, various embodiments may be described herein in terms of various functional components and processing steps. It should be appreciated that such components and steps may be realized by any number of hardware components configured to perform the specified functions.

While the foregoing detailed description will provide those skilled in the art with a convenient road map for implementing various embodiments of the invention, it should be appreciated that the particular embodiments described above are only examples, and are not intended to limit the scope, applicability, or configuration of the invention in any way. To the contrary, various changes may be made in the function and arrangement of elements described without departing from the scope of the invention.

The invention claimed is:

1. A razor storage system comprising:

a sealable container comprising a lid;

a razor platform coupled to an inside portion of the sealable container and comprising a razor chamber;

an air moving device below the razor platform and in fluid communication with a first passage through one side of the razor chamber and a second passage through an opposite side of the razor chamber;

a controller configured to control the air moving device;

a power supply coupled to the controller and configured to provide power to the controller;

a switch coupled to the controller and configured to activate the controller to start the air moving device upon closing of the lid; and a hygroscopic material configured to receive at least a portion of the air traveling through the second passage.

2. The system according to claim 1, wherein the power supply comprises a battery.

3. The system according to claim 1, wherein the power supply comprises a USB port configured to receive power from a computer, a wall plug, or a charging port.

4. The system according to claim 1, wherein the hygroscopic material is silica gel.

5. The system according to claim 1, wherein the controller is configured to provide power and start the air moving device when the switch is activated and then to terminate power to the air moving device upon at least one of an expiration of a predetermined time period and upon reaching a predetermined humidity threshold.

6. The system according to claim 1, further comprising a timer device in the controller and configured to terminate power to the air moving device upon at least one of an expiration of a predetermined time period.

7. The system according to claim 6, wherein the switch resets the timer device to zero upon opening the lid.

8. The system according to claim 7, wherein the timer device is a timer control capacitor which is coupled to a discharge assist diode configured to discharge the timer control capacitor to 0 volts.

9. The system according to claim 1, wherein the air moving device is an axial fan configured to direct an air flow through the first passage, across the razor chamber, and through the second passage.

10. The system according to claim 1, wherein the air moving device is an axial fan configured to direct an air flow through the first passage, across at least a portion of a blade of a razor in the razor chamber, then through the second passage, and across the hygroscopic material.

11. The system according to claim 1, wherein the switch comprises a magnetic fastened to the lid and is configured to magnetically attach to a pair of metal contacts in the sealable container to hold the lid in a closed position, and to close a circuit thereby activating the controller.

12. A method of extending a lifetime of a shaving razor, the method comprising:

providing a razor storage system;

opening a lid of the razor storage system;

placing a razor into a razor chamber inside the razor storage system;

closing the lid;

activating a fan in the razor storage system;

directing an air flow through the razor chamber and across at least a portion of a blade of the razor; and receiving the air flow from the razor chamber onto a hygroscopic material, thereby lowering humidity in the razor storage system.

13. The method according to claim 12, further comprising terminating power to the fan after a predetermined time period.

14. The method according to claim 13, wherein the predetermined time period is in a range from 20 seconds to 120 seconds.

15. The method according to claim 12, further comprising terminating power to the fan upon reaching a humidity threshold.

16. The method according to claim 15, wherein the humidity threshold is in the range between 40% and 70%.

17. The method according to claim 12, further comprising terminating power to the fan upon reaching a humidity threshold or upon expiration of a predetermined time period.

18. The method according to claim 12, further comprising removing at least one water droplet from the at least a portion of a blade of the razor with the air flow.

19. A razor storage system for extending a usable lifetime of razor blades, the system comprising:

a box;

a lid;

a hinge coupled to the box and the lid;

a platform positioned in the box and a chamber configured to hold a razor;

a first set of vents in a first side of the chamber;

a second set of vents in a second side of the chamber;

a controller;

a power supply coupled to controller;

a fan powered by the controller and configured move an airstream through the first set of vents then through the second set of vents;

a switch in communication with the controller and configured to start the fan when activated by the lid;

a desiccant configured to receive the airstream moved through the second set of vents; and a magnet configured to fasten the lid to the box in a closed position.

20. The claim according to claim 19, wherein the controller is configured to provide power and start the fan and then to terminate power to the fan upon at least one of an expiration of a predetermined time period and upon reaching a predetermined humidity threshold.

* * * * *